US006170927B1

(12) United States Patent
Dykstra et al.

(10) Patent No.: US 6,170,927 B1
(45) Date of Patent: Jan. 9, 2001

(54) DRAWER INTERLINK SYSTEM

(75) Inventors: James R. Dykstra, Grandville; David A. Oetman, Grand Rapids, both of MI (US)

(73) Assignee: Steelcase Development Inc., Caledonia, MI (US)

( * ) Notice: Under 35 U.S.C. 154(b), the term of this patent shall be extended for 0 days.

(21) Appl. No.: 09/196,799

(22) Filed: Nov. 20, 1998

(51) Int. Cl.[7] ..... E05C 9/00
(52) U.S. Cl. ..... 312/220; 312/219
(58) Field of Search ..... 312/220, 221, 312/217, 216, 219

(56) References Cited

U.S. PATENT DOCUMENTS

| | | |
|---|---|---|
| Re. 26,902 | 5/1970 | Levenberg . |
| 1,238,514 | 8/1917 | Hartbeck . |
| 1,868,495 | 7/1932 | Einermann . |
| 2,873,159 | 2/1959 | Becker . |
| 3,378,321 | 4/1968 | Frederick et al. . |
| 3,602,562 | 8/1971 | Radelfinger . |
| 3,650,590 | 3/1972 | Frederick et al. . |
| 3,654,878 | 4/1972 | Osojnak . |
| 3,799,638 | 3/1974 | Faiks . |
| 3,799,640 | 3/1974 | Jacobs . |
| 3,941,441 | 3/1976 | Scheerhorn . |
| 4,768,844 | 9/1988 | Ludwig . |
| 5,062,678 | 11/1991 | Westwinkel . |
| 5,176,436 | 1/1993 | Mitchell . |
| 5,199,774 | 4/1993 | Hedinger et al. . |
| 5,427,445 | 6/1995 | Mitchell . |
| 5,533,798 | 7/1996 | Feldpausch et al. . |
| 5,823,643 | 10/1998 | Feldpausch et al. . |

FOREIGN PATENT DOCUMENTS

| | | | | |
|---|---|---|---|---|
| 1257561 | * | 12/1971 | (GB) | 312/217 |
| 2079834 | * | 1/1982 | (GB) | 312/216 |
| 8902692 | * | 5/1991 | (NL) | 312/221 |

* cited by examiner

*Primary Examiner*—Carl D. Friedman
*Assistant Examiner*—David E. Allred

(57) ABSTRACT

A drawer interlinking system for a storage cabinet is disclosed herein. The cabinet includes a frame, a first sliding assembly, and a second sliding assembly. Each sliding assembly is movable between an extended position and a retracted position relative to the frame. The frame includes a flexible member coupled at a first end to the first sliding assembly. The line is directed by a first guide coupled to the frame in association with the first sliding assembly, a guide assembly coupled to the frame and spaced apart from the first guide, a glide assembly coupled to the frame by a tension member, and a second guide coupled to the frame in association with the second sliding assembly and spaced apart from the guide assembly. The flexible member is coupled at a second end to the second sliding assembly, so that when one sliding assembly is extended from the frame the other sliding assembly is retracted into the frame. The guide assembly can comprise a left pulley connected to a right pulley. The glide assembly may include a tension member, such as a spring. Further, the cabinet may include an instop bumper that centers and aligns the sliding assemblies when the sliding assemblies are in a retracted position.

23 Claims, 10 Drawing Sheets

DRAWER INTERLINK SYSTEM

FIELD OF THE INVENTION

The present invention generally relates to storage cabinets having sliding assemblies. More specifically, the present invention relates to a mobile storage cabinet having interlinked drawers where each drawer of the cabinet is movable between an extended and a retracted position so that when a worker extends one drawer from the cabinet the other drawer is retracted into the cabinet.

BACKGROUND OF THE INVENTION

Storage cabinets for stowing and organizing contents have been known for many years. Such cabinets typically include a plurality of drawers. Contents (e.g., files, papers, office utensils) are stowed in the drawers of the cabinet for access by workers. Typically, the center of gravity of the cabinet shifts toward the front of the cabinet when a worker extends a drawer to retrieve the contents therein. The center of the gravity is further shifted toward the front of the cabinet when a second or third drawer is also extended to retrieve the contents therein. The shift in the center of gravity toward the front of the cabinet may cause the cabinet to tip forward resulting in the spillage of the stored contents, or even overturn.

Several attempts have been made to prevent cabinets from tipping forward or overturning. One attempt includes providing a heavy weight attached to the back end of a cabinet. The weight can decrease the degree to which the center of gravity of the cabinet shifts forward as a drawer is extended. However, cabinets of this type are bulky and weighty, which reduces the mobility of the cabinet and increases costs of manufacture and shipping. Another attempt to prevent cabinets from overturning includes anchoring the cabinet to a floor or wall. However, anchoring the cabinet eliminates the mobility of the cabinet.

Still another attempt to prevent cabinets from overturning includes using a cord linking the drawers of the cabinet and having only enough slack to allow one drawer to be completely extended at a given moment in time. When so linked, the cord causes one drawer to retract when another drawer is extended. However, the linking action of the drawers is not smooth or immediate because of slack in the cord, which inhibits a direct response between the extension of one drawer and the retraction of another drawer. Some cabinets include a counterbalance to reduce the slack in the cord, but the counterbalance further adds to the overall weight of the cabinet, which reduces the mobility of the cabinet.

Accordingly, it would be advantageous to provide a cabinet for stowing contents that overcomes these and other disadvantages of the related art. In particular, it would be advantageous to provide a cabinet for storing items that does not easily tip forward or overturn when a drawer is extended. Further, it would be advantageous to provide a cabinet that is not weighted so greatly that it is difficult to move. It would also be advantageous to provide a cabinet with interlinked drawers so that one drawer is retracted in direct response to the extension of another drawer.

SUMMARY OF THE INVENTION

The present invention relates to a drawer interlinking system for a storage cabinet. The cabinet includes a frame, a first sliding assembly, and a second sliding assembly. Each sliding assembly (preferably, a drawer) is selectively configured between an extended position and a retracted position relative to the frame. The system includes a flexible member having a first end coupled to the first sliding assembly. The system also includes a first guide, coupled to the frame relative to the first sliding assembly, that directs the flexible member. The system further includes a first primary guide, coupled to the frame and spaced a distance from the first guide, that directs the flexible member. The system still further includes a connecting guide, coupled to the frame by a connecting member, that directs the flexible member. In addition, the system includes a second primary guide, coupled to the frame and spaced a distance from the first guide, that directs the flexible member. Further, the system includes a second guide, coupled to the frame relative to the second sliding assembly and spaced a distance from the first and second primary guides, that directs the flexible member. The flexible member has a second end coupled to the second sliding assembly, so that when the first sliding assembly is extended from the frame the second sliding assembly is retracted into the frame.

The present invention further relates to an interlinking system for a storage cabinet. The cabinet provides a frame, a first sliding assembly, and a second sliding assembly (such as drawers), each sliding assembly being movable between an extended position and a retracted position relative to the frame to open and close the drawers, respectively. The system includes a first guide coupled to the frame relative to the first sliding assembly. The system also includes a first primary guide coupled to the frame and spaced a distance from the first guide. The system further includes a connecting guide coupled to the frame by a connecting member. The connecting member prevents slack from accumulating in the flexible member. The system still further includes a second primary guide coupled to the frame and spaced a distance from the first guide. In addition, the system includes a second guide coupled to the frame in association with the second sliding assembly and spaced a distance from the first and second primary guides. Further, the system includes a flexible member having a first end and a second end. The first end of the flexible member is coupled to the first sliding assembly, the second end of the flexible member is coupled to the second sliding assembly. The flexible member is directed by the first guide, the first primary guide, the connecting guide, the second primary guide, and the second guide. When the first sliding assembly is extended from the frame the second sliding assembly is retracted into the frame.

The present invention further relates to a method of operating an interlinking system. The interlinking system provides a storage cabinet having a frame, a first sliding assembly and a second sliding assembly. Each sliding assembly is selectively configured between an extended position, a retracted position, and a combination thereof relative to the frame. The interlinking system further provides a flexible member having a first end coupled to the first sliding assembly. The interlinking system still further provides a first guide, coupled to the frame relative to the first sliding assembly, that directs the flexible member. Also, the interlinking system provides a first primary guide, coupled to the frame and spaced a distance from the first guide, that directs the flexible member. Further, the interlinking system provides a glide, coupled to the frame by a connecting member, that directs the flexible member. The interlinking system also includes a second primary guide, coupled to the frame and spaced a distance from the first guide, that directs the flexible member. Still further, the interlinking system includes a second guide, coupled to the frame relative to the second sliding assembly and spaced a distance from the first and second primary guides, that directs the flexible member. The flexible member has a second end coupled to the second sliding assembly. The method includes extending the first sliding assembly to create tension on the flexible member. The method further includes directing the flexible member with the first guide. The method still further includes directing the flexible member with the first primary guide. In addition, the method includes directing the flexible member with the glide assembly. Further, the method includes directing the flexible member with the second primary guide. Still further, the method includes directing the flexible member with the second guide.

DETAILED DESCRIPTION OF THE PREFERRED EMBODIMENTS

Figure 1:
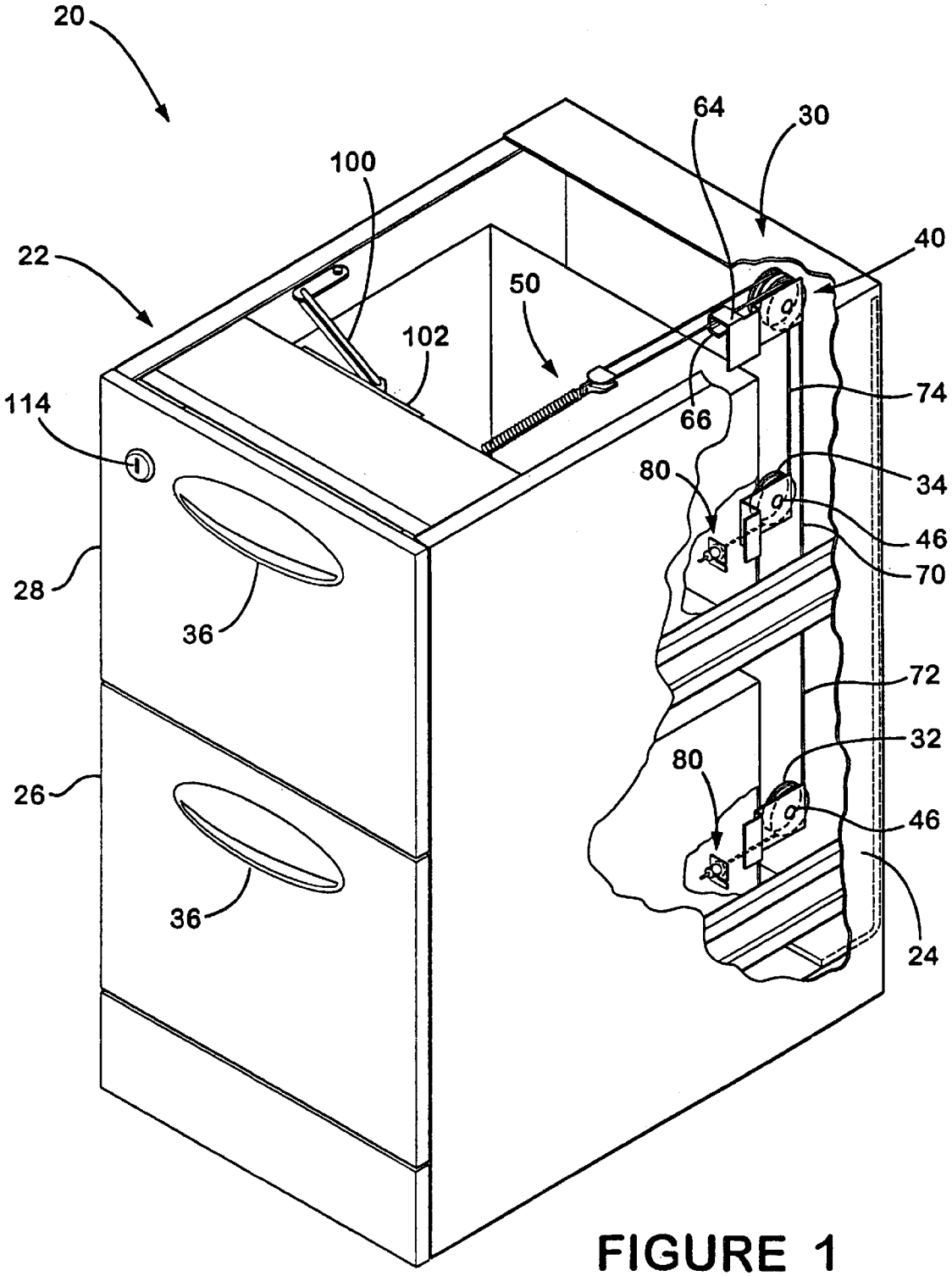
FIG. 1 is a perspective view of a drawer interlinking system according to a preferred embodiment of the present invention.

Referring to the FIG. 1, a drawer interlinking system 20 is shown according to a preferred embodiment of the present invention. The system may include any type of compartment, chest, or cabinet with sliding assemblies, separators, or drawers. FIG. 1 shows the basic elements of drawer interlinking system 20 according to an exemplary embodiment of the invention. System 20 includes a chamber (shown as a cabinet 22 in FIG. 1) having a frame 24, a top and a bottom sliding assembly (shown as drawers 26 and 28 in FIG. 1), a flexible member 70, a plurality of guides 30, and a glide assembly 50. Plurality of guides 30 interact with and direct flexible member 70 as drawers 26 and 28 are extended and retracted relative to frame 24 of cabinet 22. Flexible member 70 and plurality of guides 30 coact to interlink drawers 26 and 28. A line attachment assembly 80 secures flexible member 70 to bottom and top drawers 26 and 28. Tension is placed on flexible member 70 to ensure that bottom drawer 26 is retracted when top drawer 28 is extended (and vice versa) relative to cabinet 22.

Figure 2:
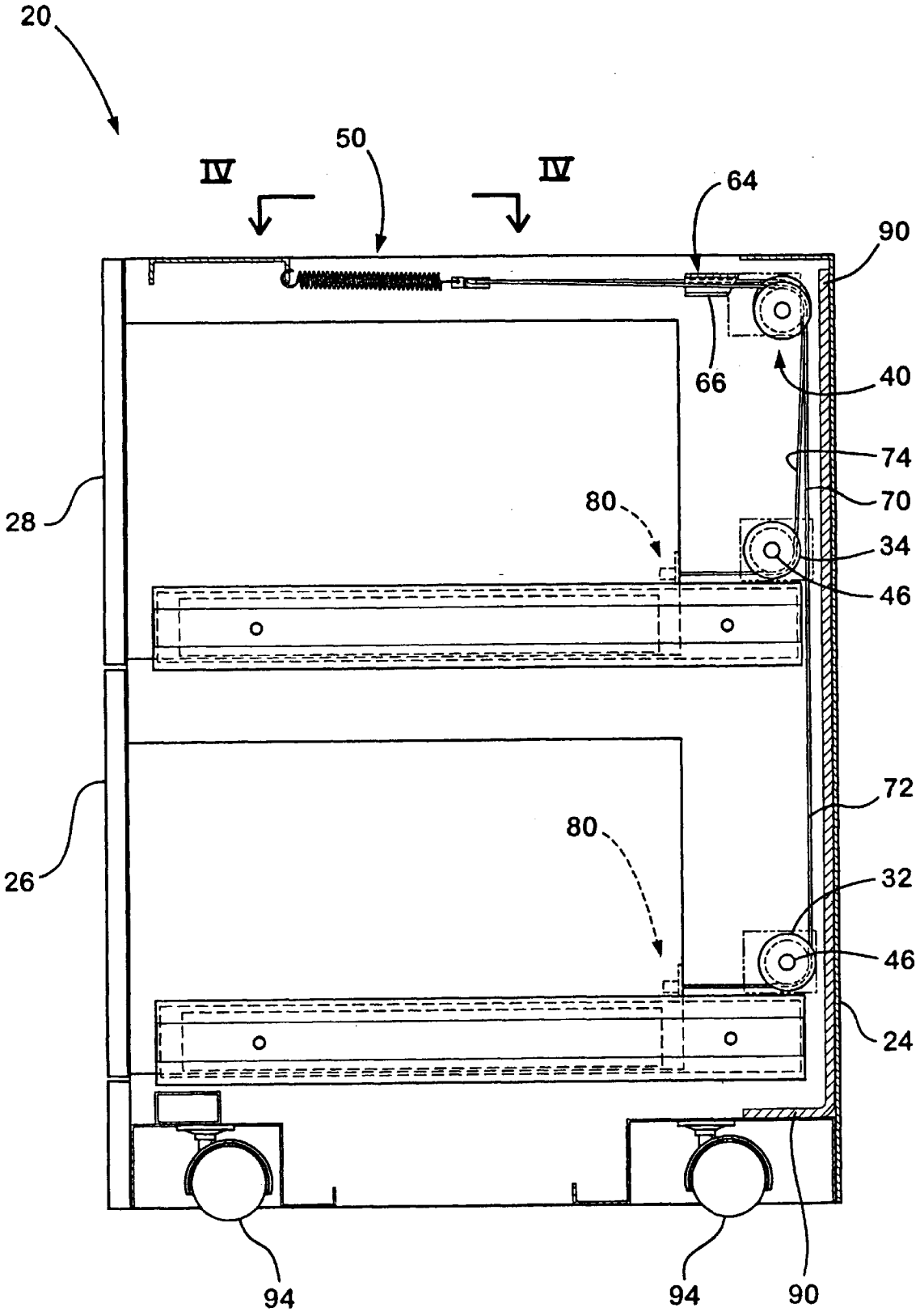
FIG. 2 is a sectional side elevation view of the drawer interlinking system of FIG. 1.

In FIG. 2, system 20 includes cabinet 22 providing frame 24 having bottom drawer 26 and top drawer 28 (a plurality of drawers may be included) having pulls 36. According to a particularly preferred embodiment, cabinet 22 is designed to be mobile and capable of being positioned under a work surface (e.g., table, desk, counter). Bottom drawer 26 and top drawer 28 are removable between an extended and retracted position relative to frame 24. Drawers 26 and 28 are preferably inclined slightly toward the rear of cabinet 22. According to a particularly preferred embodiment, drawers 26 and 28 are inclined one-half degree toward the rear of cabinet 22. The incline of drawers 26 and 28 permits some countermeasure to the downward force applied by contents 92 (e.g., files, books, office products) of drawers 26 and 28. Cabinet 22 further includes a weight 90 rigidly mounted to the back of cabinet 22 by a fastener shown as a screw 86 through a hole 88. According to a particularly preferred embodiment, weight 90 is approximately twenty-seven pounds for a two-drawer, twenty-four inch high mobile cabinet. Weight 90 provides some countermeasure to the downward force applied by contents 92 of drawers 26 and 28 when in an extended position. A caster 94 is rotably mounted to the bottom of cabinet 22. Casters 94 permit movement of cabinet 22. Cabinet 22 further includes a lock bar 100 having a hook 102 and a lock 112. Hooks 102 of lock bar 100 increasingly engage the sides of drawers 26 and 28 as drawers 26 or 28 are pulled with increased force when lock 112 is engaged. Drawers 26 and 28 of cabinet 22 further include an instop bumper (not shown). The instop bumper centers and aligns drawers 26 and 28 when the drawers are in a retracted position.

Figure 6:
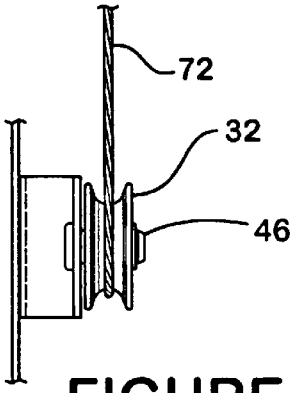
FIG. 6 is a fragmentary side elevation view of a guide according to an exemplary embodiment of the present invention.
Figure 7:
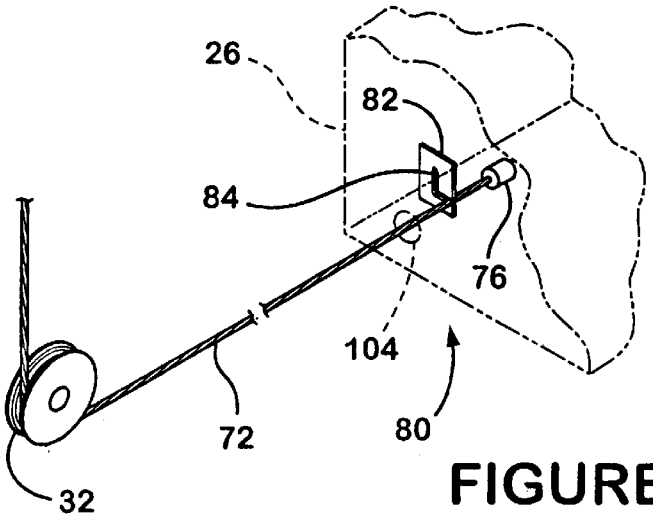
FIG. 7 is a fragmentary exploded perspective view of the line attachment assembly of the drawer interlinking system according to an exemplary embodiment of the present invention.

Flexible member 70 includes ends 72 and 74, and tabs 76. Tabs 76 are situated at the terminus of first and second ends 72 and 74 of flexible member 70. Flexible member 70 can be any material (e.g., cable, string, wire) capable of interaction with and direction by plurality of guides 30. According to a particularly preferred embodiment, flexible member 70 is "7×7" coated cable, Part No. 892800008 available from Grand Rapids Controls of Grand Rapids, Mich. Line attachment assembly 80 secures first and second ends 72 and 74 of flexible member 70 to the back of bottom and top drawers 26 and 28, respectively (see FIG. 7). Line attachment assembly 80 prevents flexible member 70 from exiting drawers 26 and 28 through a hole 104. Line attachment assembly 80 includes a clip 82. According to a particularly preferred embodiment, clip 82 is rectangular-shaped having an "L"-shaped inner channel 84. Tabs 76 of first and second ends 72 and 74 of flexible member 70 fit through hole 104 of bottom and top drawers 26 and 28, respectively. Inner channel 84 permits clip 82 to circumscribe flexible member 70. The outer perimenter of clip 82 is greater than the outer perimeter of hole 104, and the width of tab 76 is wider than the diameter of inner channel 84 of clip 82. Accordingly, when glide assembly 50 creates tension on flexible member 70, tab 76 presses against clip 82, which in turn, presses against hole 104 of drawers 26 and 28 so that tab 76 is secured to the back of bottom and top drawers 26 and 28, respectively A bottom drawer guide 32 (such as a first guide), a top drawer guide 34 (such as a second guide), a guide assembly 40 (such as a first and second primary guide) and glide assembly 50 (such as a connecting guide) interact with and direct flexible member 70. The portion of flexible member 70 associated with first end 72 interacts with and is directed by bottom drawer guide 32 associated with bottom drawer 26. Bottom drawer guide 32 is mounted to frame 24 of cabinet 22 by a connecting member. According to a particularly preferred embodiment, the connector is an elongate finger 46 that extends from frame 24 of cabinet 22, and bottom drawer guide 32 is a plastic pulley that rotates. (See FIG. 6.) Line attachment assembly 80 secures first end 72 of flexible member 70 to clip 82 and the back of bottom drawer 26. The portion of flexible member 70 associated with second end 74 interacts with and is guided by top drawer guide 34 associated with top drawer 28. Top drawer guide 34 is mounted to frame 24 of cabinet 22 by a connector (e.g., elongate finger 46). According to a particularly preferred embodiment, top drawer guide 34 is a plastic pulley that rotates. (See FIG. 6.) Line attachment assembly 80 secures second end 74 of flexible member 70 to clip 82 and the back of top drawer 28.

Figure 5:
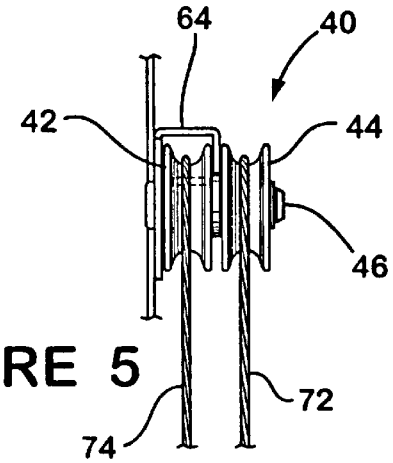
FIG. 5 is a fragmentary side elevation view of a guide assembly according to an exemplary embodiment of the present invention.

Guide assembly 40 further interacts with and directs flexible member 70. (See FIG. 5.) Guide assembly 40 is spaced a distance from top and bottom drawer guides 32 and 34. Guide assembly 40 includes a left and a right guide 42 and 44. According to a particularly preferred embodiment, left and right guides 42 and 44 of guide assembly 40 are plastic pulleys that rotate, and further, left guide 42 is preferably coupled to right guide 44 (or vice versa). Guide assembly 40 is mounted to frame 24 of cabinet 22 by a connector. According to a particularly preferred embodiment, the connector is elongate finger 46 that extends from frame 24 of cabinet 22, and left and right guides 42 and 44 are plastic pulleys that rotate. In operation, when drawers 26 and 28 are extended and retracted, left guide 42 of guide assembly 40 interacts with and directs the portion of flexible member 70 associated with second end 74, and right guide 44 of guide assembly 40 interacts with and directs the portion of flexible member 70 associated with first end 72.

Figure 4:
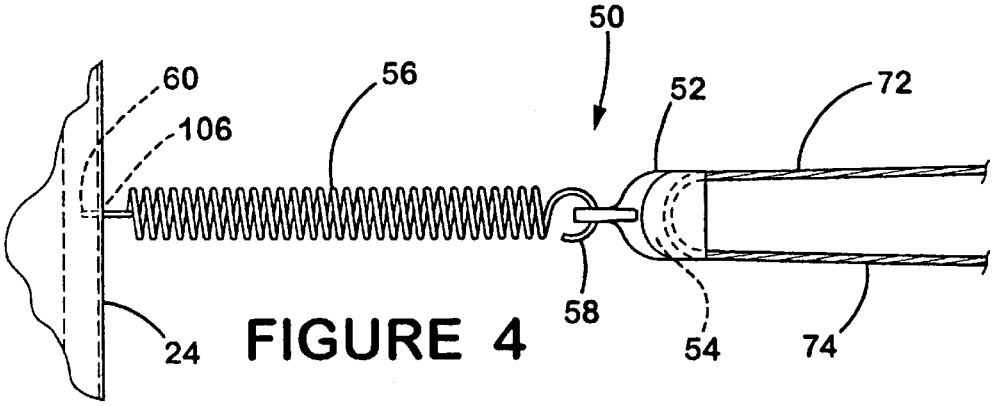
FIG. 4 is a fragmentary cross sectional view of a guide assembly taken along line iv—iv of FIG. 2 according to an exemplary embodiment.

Glide assembly 50 still further interacts with and directs flexible member 70. (See FIG. 4.) Glide assembly 50 preferably includes a lead 52, and a tension member (such as a connecting member). Glide assembly 50 serves to prevent slack from accumulating in flexible member 70. The tension member is preferably a tensioned device (e.g., spring, elastic band, sponge). According to a particularly preferred embodiment, tension member is a spring 56, such as a coil metal spring (e.g., Part No. 80120110 available from Wolverine Coil, Incorporated of Grand Rapids, Mich.). Spring 56 has a spring constant great enough to grab any slack in flexible member 70 necessary when drawers 26 and 28 are extended or retracted. Hooks are provided at each end of the spring 56. A first hook 58 of spring 56 is inserted through a hole 106 of frame 24 of cabinet 22. A second hook 60 of spring 56 is inserted through a hole 114 of lead 52. Lead 52 is preferably rectangular shaped having a passage 54. Passage 54 is curved (e.g., "U"-shaped) to interact with and direct flexible member 70 through lead 52. Lead 52 functions like a pulley in relation to flexible member 70, but does not rotate. Lead 52 is positioned in the horizontal plane so that the portions of flexible member 70 associated with first and second ends 72 and 74 do not strike one another. Contact occurs between the portions of flexible member 70 associated with first and second ends 72 and 74 if lead 52 is positioned in the vertical plane.

A stop mechanism 64 is located between lead 52 and guide assembly 40. A fastener, such as a screw 108, is inserted through a hole 110 to connect stop mechanism 64 to frame 24 of cabinet 22. The tension on glide assembly 50 created by the extension of bottom or top drawers 26 and 28 causes lead 52 to move toward guide assembly 40. Stop mechanism 64 prohibits lead 52 of glide assembly 50 from striking guide assembly 40. Stop mechanism 64 includes a lip 66 provided between the portions of flexible member 70 associated with first and second ends 72 and 74. Lip 66 ensures that the portions of flexible member 70 associated with first and second ends 72 and 74 do not strike one another. Spring 56 is fully extended so that lead 52 is adjacent to stop mechanism 64 when bottom drawer 28 is in the fully extended position and bottom drawer 26 is in the fully retracted position (or vice versa) (see FIGS. 3A and 3C), or alternatively, when both drawers 26 and 28 are in a partially extended position relative to frame 24 (see, e.g., FIG. 3B).

Referring to FIG. 1, drawers 26 and 28 are in a fully retracted position. In operation, when bottom drawer 26 is subsequently extended (see, e.g., FIG. 3A) the following occurs: lead 52 and spring 56 move toward stop mechanism 64; right guide 44 of guide assembly 40 interacts with and directs the portion of flexible member 70 associated with first end 72; but the portion of flexible member 70 associated with second end 74, left guide 42 of guide assembly 40, and top drawer guide 34 remain essentially motionless. Likewise, when drawers 26 and 28 are in a fully retracted position (as shown in FIG. 1), and top drawer 28 is subsequently extended (see, e.g., FIG. 3C) the following occurs: lead 52 and spring 56 move toward stop mechanism 64; left guide 42 of guide assembly 40 interacts with and directs the portion of flexible member 70 associated with second end 74; but the portion of flexible member 70 associated with first end 72, right guide 44 of guide assembly 40, and bottom drawer guide 32 remain essentially motionless.

Operation of interlinked drawers 26 and 28 of cabinet 22 between an extended and a retracted position is best shown by reference to FIGS. 1 and 3A through 3C. Referring to FIG. 1, drawers 26 and 28 of cabinet 22 are both in a fully retracted position. Spring 56 is only slightly extended and glide assembly 50 exerts a slight tension that grabs slack in flexible member 70.

Bottom drawer 26 must be extended (as shown in FIG. 1) to retrieve the contents 92 therein. The extension of bottom drawer 26 exerts a tension on first end 72 of flexible member 70. Consequently, first end 72 of flexible member 70 exerts a tension on glide assembly 50, which causes glide assembly 50 to move toward stop mechanism 64. The extension of the bottom drawer 26 (when top drawer 28 is in a retracted position) does not exert a significant tension on second end 74 of flexible member 70. When bottom drawer 26 is in a fully extended position (as in FIG. 3A) spring 56 is fully extended and stop mechanism 64 prevents lead 52 from moving further toward guide assembly 40.

Figure 3A:
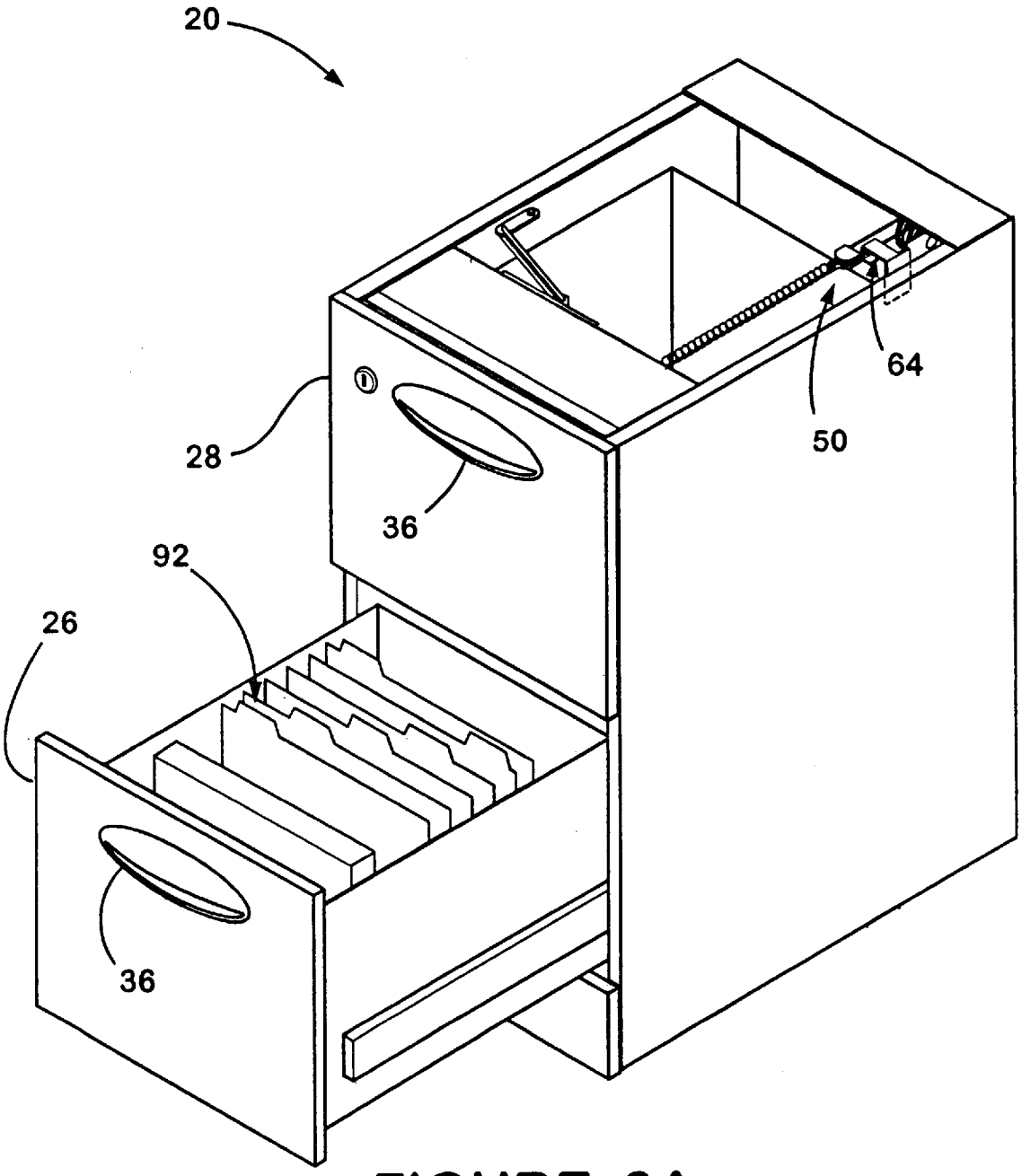
FIGS. 3A, 3B, and 3C are perspective views of the drawer interlinking system of FIG. 1 with each drawer in a translated position.
Figure 3B:
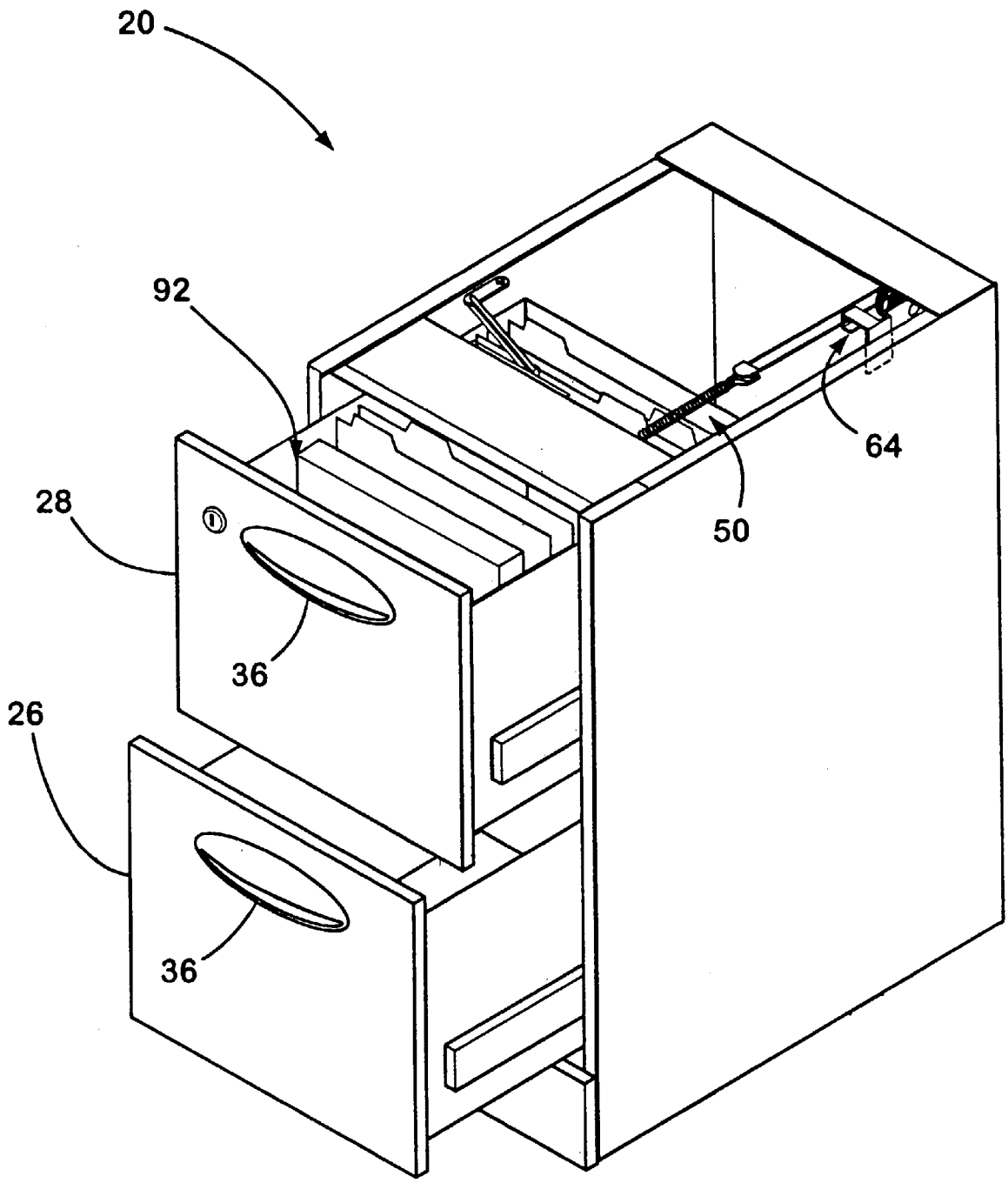

Referring to FIG. 3A, bottom drawer 26 is in a fully extended position and top drawer 28 is in a fully retracted position. Top drawer 28 must be extended to obtain contents 92 therein. As top drawer 28 is extended, the portion of flexible member 70 associated with second end 74 exerts a tension on glide assembly 50. Stop mechanism 64 prevents glide assembly 50 from further moving toward guide assembly 40. Spring 56 remains fully extended so glide assembly 50 neither takes nor donates a significant amount of slack to flexible member 70. Consequently, second end 74 of flexible member 70 exerts a tension on first end 72 of flexible member 70, flexible member 70 interacts with and is directed by passage 54 of glide assembly 40, which causes bottom drawer 26 to partially retract relative to frame 24 (as in FIG. 3B, showing bottom drawer 26 in a partially retracted position and top drawer 28 in a partially extended position). Bottom drawer 26 and top drawer 28 are interlinked by flexible member 70, plurality of guides 30, and glide assembly 50. Thus, the further extension of top drawer 28 causes bottom drawer 26 to be further retracted into frame 24 until top drawer 28 is in a fully extended position and bottom drawer 26 is in a fully retracted position (as shown in FIG. 3C).

Figure 3C:
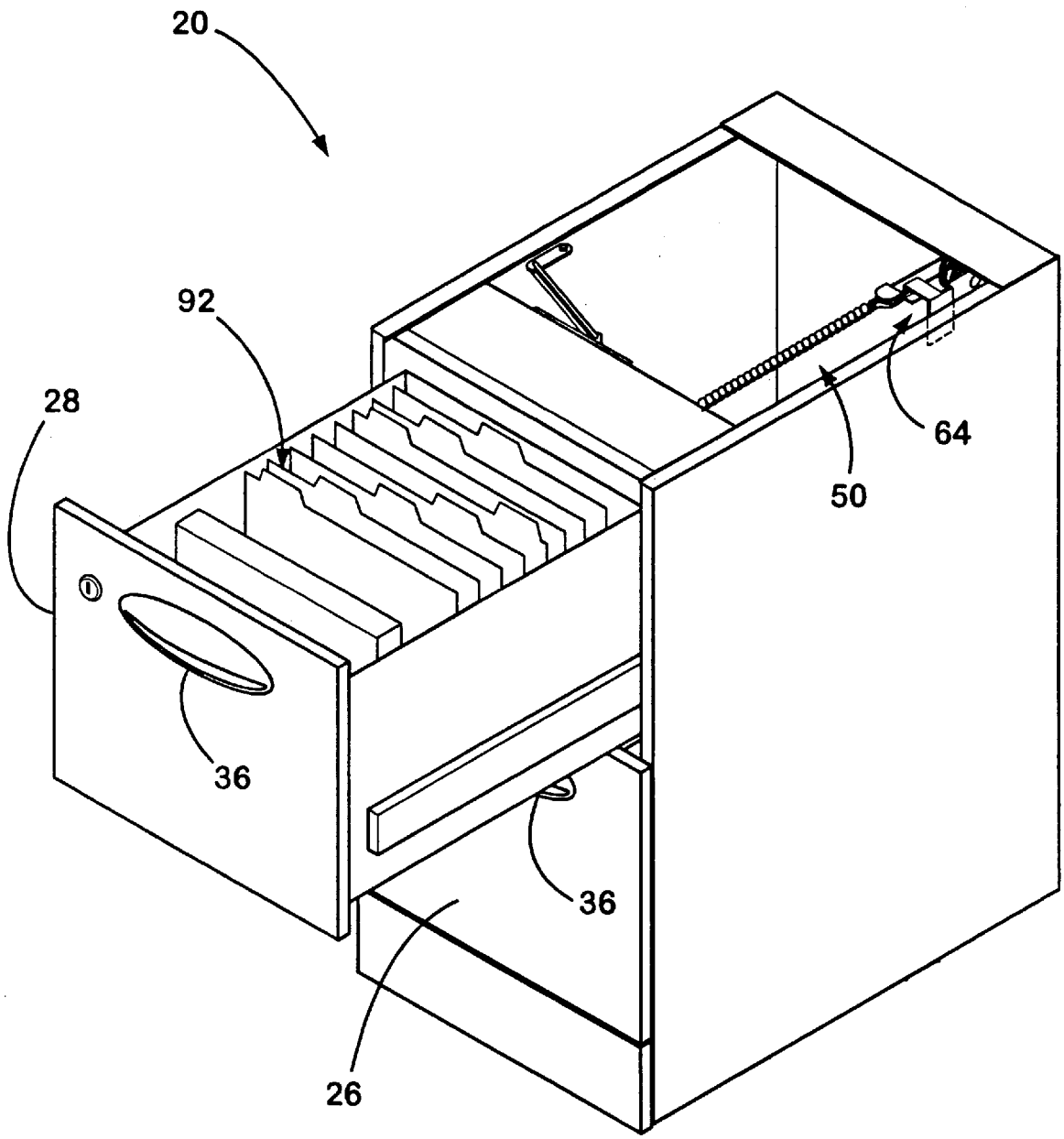

Top drawer 28 can be retracted from its fully extended position (as shown in FIG. 3C). In so doing, spring 56 grabs the slack in flexible member 70. Accordingly, the following occurs: spring 56 moves toward the front of cabinet 22; lead 52 moves toward the front of cabinet 22; the portion of flexible member 70 associated with second end 74 interacts with and is directed by left guide 42 of guide assembly 40; but flexible member 70 associated with first end 72, right guide 44 of guide assembly 40, and bottom drawer guide 32 remain essentially motionless.

Figure 8:
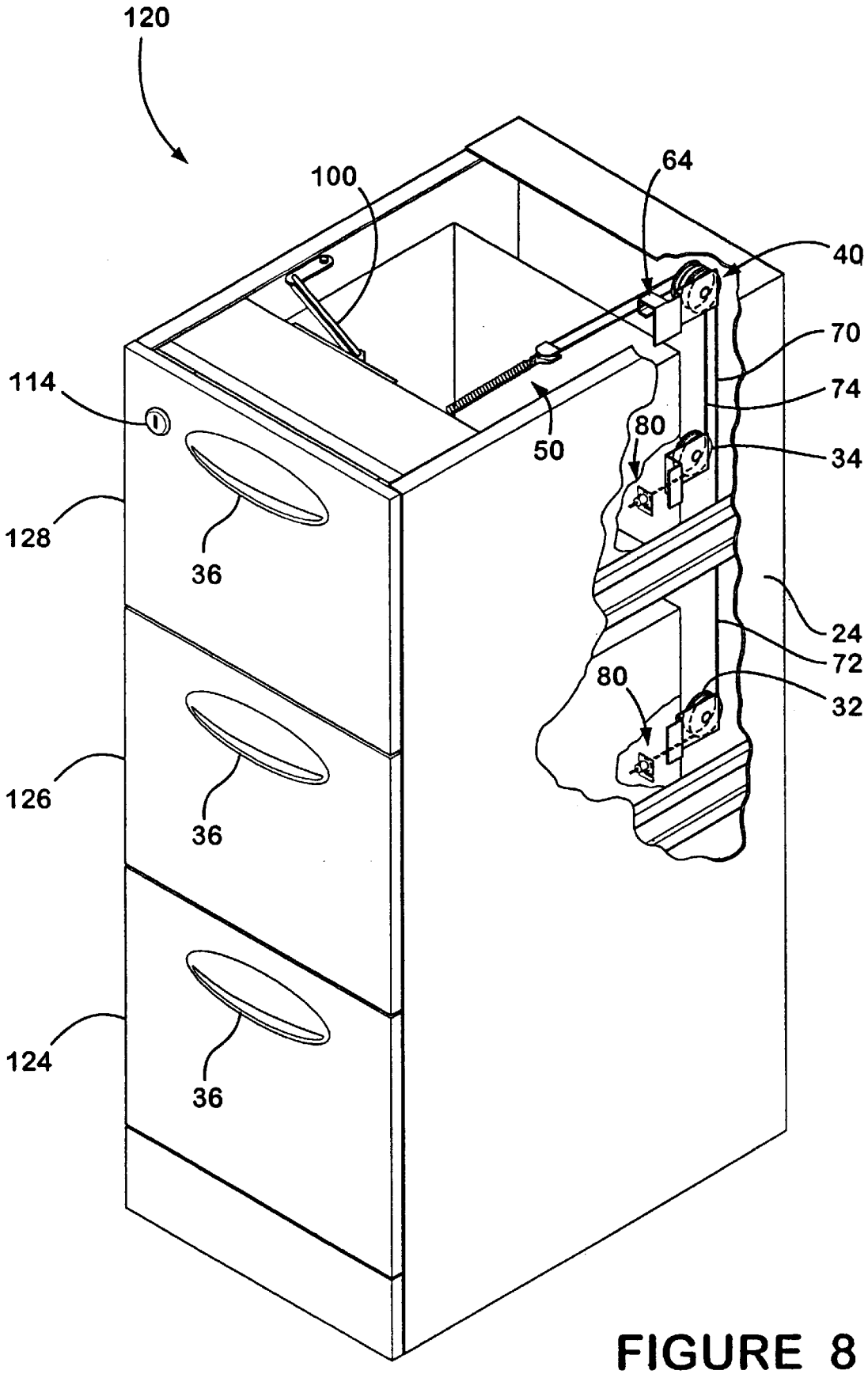
FIG. 8 is a perspective view of the drawer interlinking system according to an alternative embodiment of the present invention.

FIG. 8 shows a drawer interlinking system 120 according to an alternative embodiment of the present invention. System 120 includes a middle, a top and a bottom sliding assembly shown as a middle, a top and a bottom drawer 126, 128, and 124, respectively. Bottom drawer 124 is not interlinked to middle and top drawers 126 and 128. In all other respects, system 120 is essentially the same as system 22 in structure, function, and operation, and the like reference numerals identify like elements. According to a particularly preferred embodiment, the drawer that is not interlinked (i.e., bottom drawer 124 as shown in FIG. 8) is located between the interlinked drawers (such as middle and top drawers 126 and 128 as shown in FIG. 8).

Figure 9A:
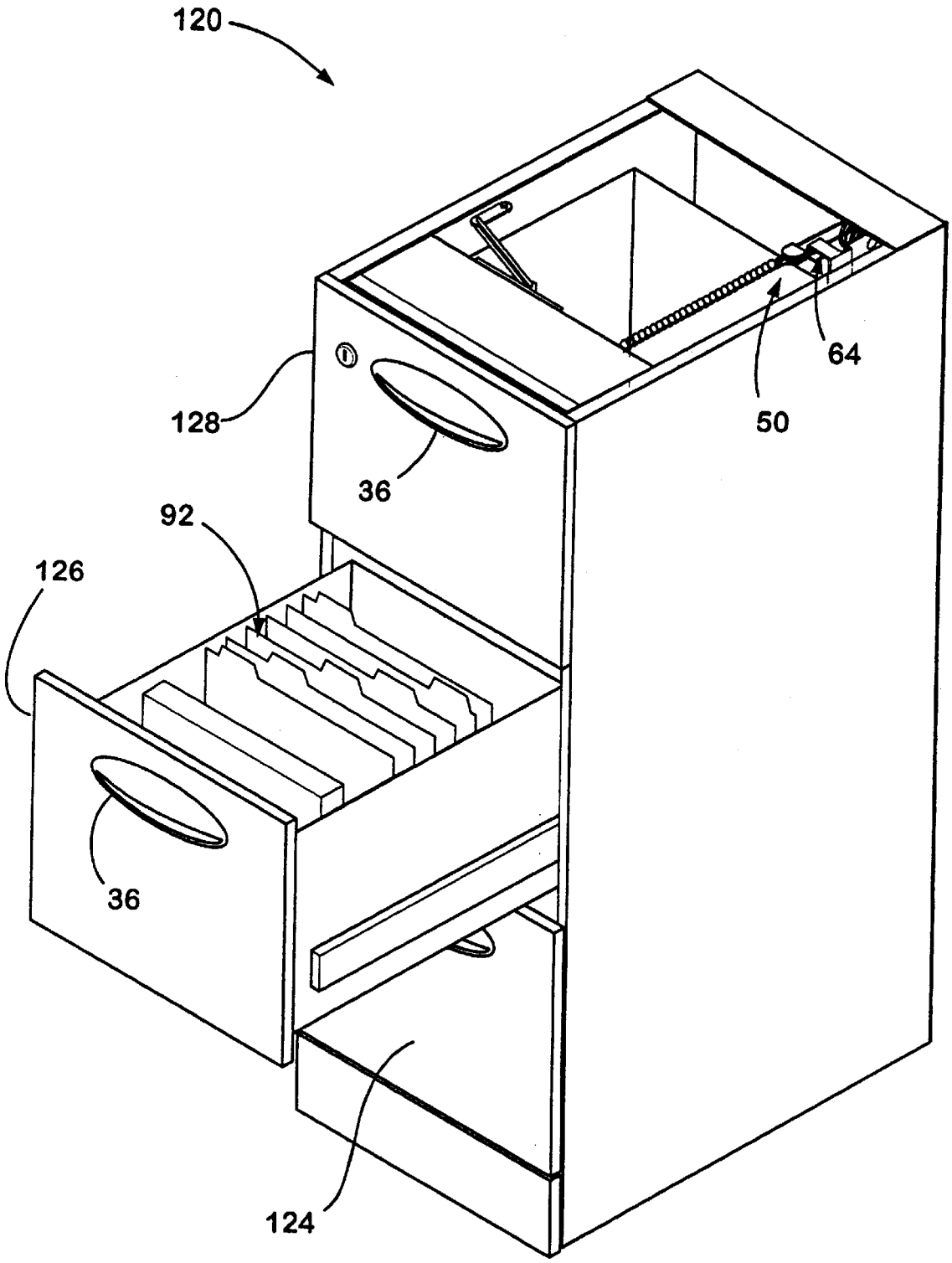
FIGS. 9A, 9B, and 9C are perspective views of the drawer interlinking system of FIG. 8 with two drawers in translated positions.
Figure 9B:
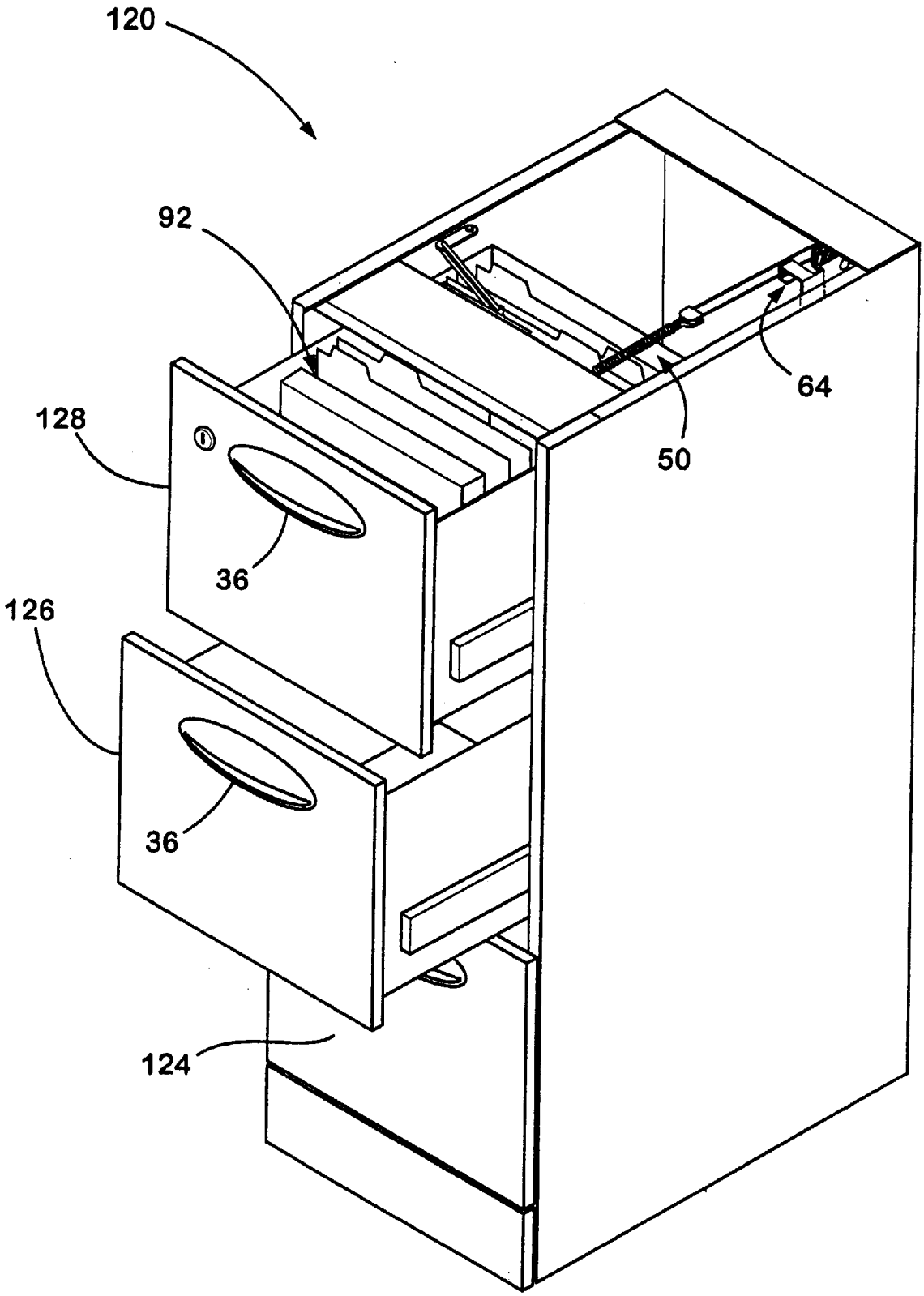
Figure 9C:
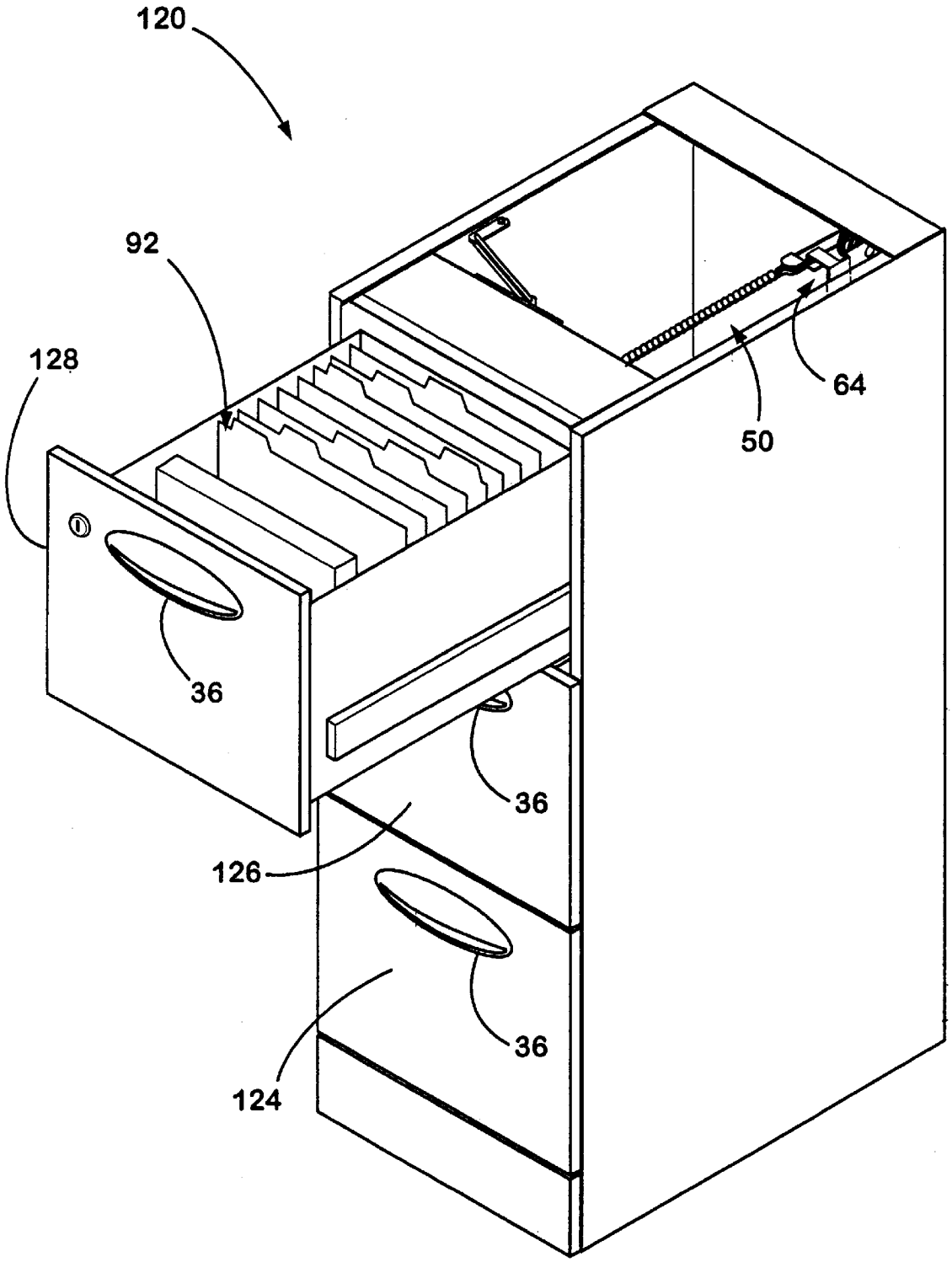

FIGS. 9A, 9B, and 9C further detail drawer interlinking system 120 of FIG. 8 according to a particularly preferred embodiment. Middle and top drawers 126 and 128 are interlinked such that top drawer 128 is retracted when middle drawer 126 is extended (see, e.g., FIG. 9A). Likewise, middle door 126 is retracted when top drawer 128 is extended (see, e.g., FIG. 9C). Bottom drawer 124 is not interlinked and may be extended or retracted regardless of the position of middle and top drawers 126 and 128. According to an alternative embodiment, the top drawer (or multiple drawers) is not interlinked to the bottom and middle interlinked drawers in a three (or more) drawer file cabinet, and the top and middle drawers are smaller in size than the bottom drawer.

Although only a few exemplary embodiments of the present invention have been described in detail in this disclosure, those skilled in the art who review this disclosure will readily appreciate that many modifications are possible in the exemplary embodiments (such as variations in sizes, structures, shapes, weights and proportions of the various elements, values of parameters, mounting arrangements, use of materials, number of drawers, or placement of drawers) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed:

1. An interlinking system for a storage cabinet having a frame, a first compartment assembly and a second compartment assembly, each compartment assembly being movable between an extended position and a retracted position relative to the frame, the interlinking system comprising:

a first guide coupled to the frame relative to the first compartment assembly;

a first primary guide coupled to the frame and spaced a distance from the first guide for directing a flexible link;

a connecting guide coupled to the frame by a connecting member for directing the flexible link;

a second primary guide coupled to the frame and spaced a distance from the first guide for directing the flexible link;

a second guide coupled to the frame in association with the second compartment assembly and spaced a distance from the first primary guide and the second primary guide for directing the flexible link; and wherein the connecting guide is positioned between a first end of the flexible link and a second end of the flexible link, wherein the first end is fixed to the first compartment assembly and the second end is fixed to the second compartment assembly, and wherein the flexible link is guided by the first guide, the first primary guide, the connecting guide, the second primary guide, and the second guide, respectively along a length of the flexible link;

whereby the first compartment assembly is retracted into the frame when the second compartment assembly is extended from the frame.

2. The interlinking system of claim 1 wherein the flexible link is a cable.

3. The interlinking system of claim 1 wherein the first guide is a first pulley, the second guide is a second pulley, and the connecting guide is a pulley.

4. The interlinking system of claim 1 wherein the connecting member includes a spring.

5. The interlinking system of claim 1 wherein the first end of the flexible link is coupled to a back portion of the first compartment assembly and the second end of the flexible link is coupled to a back portion of the second compartment assembly.

6. A method of operating an interlinking system providing a storage cabinet having a frame, a first compartment assembly and a second compartment assembly, each compartment assembly selectively configured for selective movement between an extended position and a retracted position relative to the frame, a flexible link having a first end fixed to the first compartment assembly, a first guide coupled to the frame relative to the first compartment assembly, a first primary guide coupled to the frame and spaced a distance from the first guide, a glide coupled to the frame by a connecting member, a second primary guide coupled to the frame and spaced a distance from the first guide, a second guide coupled to the frame relative to the second compartment assembly and spaced a distance from the first and second primary guides, the flexible link having a second end fixed to the second compartment assembly, comprising:

extending the first compartment assembly thereby providing a tension on the flexible link and thereby moving the glide, wherein the system responds by:

directing the flexible link with the first guide, the first primary guide, the glide, the second primary guide, and the second guide, respectively along a length of the flexible link; and exerting a tension on the first end of the flexible link and the second end of the flexible link to reduce slack in the flexible link,;

wherein the first compartment assembly is retracted into the frame when the second compartment assembly extended from the frame.

7. The method of claim 6 further comprising extending the second compartment assembly so that the first compartment assembly is retracted into the frame.

8. The method of claim 7 wherein extending the second compartment assembly thereby provides a tension on the flexible link.

9. The method of claim 7 wherein extending the first compartment assembly thereby provides tension on the flexible link.

10. An interlinking system for a storage cabinet having a frame, a first compartment assembly and a second compartment assembly, each compartment assembly selectively configured for selective movement between an extended position and a retracted position relative to the frame, comprising:

a flexible link having a first end fixed to the first compartment assembly and a second end fixed to the second compartment assembly;

a first guide coupled to the frame relative to the first compartment assembly adapted for directing the flexible link;

a first primary guide coupled to the frame and spaced a distance from the first guide adapted for directing the flexible link;

a connecting guide coupled to the frame between the first end of the flexible link and the second end of the flexible link by a connecting member adapted for directing the flexible link;

a second primary guide coupled to the frame and spaced a distance from the first guide adapted for directing the flexible link;

a second guide coupled to the frame relative to the second compartment assembly and spaced a distance from the first primary guide and the second primary guide adapted for directing the flexible link; and wherein the flexible link is guided by the first guide, the first primary guide, the connecting guide, the second primary guide, and the second guide, respectively along a length of the flexible link so that the first compartment assembly is retracted into the frame when the second compartment assembly is extended from the frame.

11. The interlinking system of claim 10 wherein the compartment assembly is a drawer adapted for sliding movement relative to the frame.

12. The interlinking system of claim 10 wherein the connecting guide comprises a lead having a channel.

13. The interlinking system of claim 10 wherein the compartment assembly is a sliding drawer.

14. The interlinking system of claim 10 further comprising a stop mechanism for separating the first end and the second end of the flexible link.

15. The interlinking system of claim 10 wherein the connecting guide is adapted to exert a substantially equal tension on the first end of the flexible link and the second end of the flexible link.

16. The interlinking system of claim 10 wherein the flexible link includes a continuous cable.

17. The interlinking system of claim 10 wherein the connecting guide includes a passage for guiding the flexible link.

18. The interlinking system of claim 10 wherein the first primary guide is coupled to the second primary guide.

19. The interlinking system of claim 11 wherein the first guide and the second primary guide comprise a primary pulley.

20. The interlinking system of claim 12 wherein the first guide is a first pulley, the second guide is a second pulley, and the connecting guide is a third pulley.

21. The interlinking system of claim 13 wherein the connecting member includes a spring.

22. The interlinking system of claim 14 wherein the first end of the flexible link is coupled to a back portion of the first compartment assembly and the second end of the flexible link is coupled to a back portion of the second compartment assembly.

23. The interlinking system of claim 10 wherein the connecting guide is attached to a spring.

* * * * *